US011131432B2

(12) United States Patent
Catalano

(10) Patent No.: US 11,131,432 B2
(45) Date of Patent: Sep. 28, 2021

(54) VARIABLE BEAM SOURCE WITH MIXING CHAMBER

(71) Applicant: Anthony W. Catalano, Boulder, CO (US)

(72) Inventor: Anthony W. Catalano, Boulder, CO (US)

(73) Assignee: LEDVANCE LLC, Wilmington, MA (US)

( * ) Notice: Subject to any disclaimer, the term of this patent is extended or adjusted under 35 U.S.C. 154(b) by 0 days.

(21) Appl. No.: 16/515,123

(22) Filed: Jul. 18, 2019

(65) Prior Publication Data

US 2019/0342961 A1 Nov. 7, 2019

Related U.S. Application Data

(63) Continuation of application No. 14/966,537, filed on Dec. 11, 2015, now Pat. No. 10,405,388.

(60) Provisional application No. 62/090,567, filed on Dec. 11, 2014.

(51) Int. Cl.

| | |
|---|---|
| ***F21V 7/00*** | (2006.01) |
| ***F21K 9/62*** | (2016.01) |
| ***F21V 9/30*** | (2018.01) |
| ***F21V 13/14*** | (2006.01) |
| ***H05B 45/30*** | (2020.01) |
| *F21V 7/06* | (2006.01) |
| *F21V 23/00* | (2015.01) |
| *F21K 9/64* | (2016.01) |
| *F21Y 115/10* | (2016.01) |
| *F21S 10/00* | (2006.01) |

(Continued)

(52) U.S. Cl.

CPC ..... *F21K 9/62* (2016.08); *F21V 9/30* (2018.02); *F21V 13/14* (2013.01); *H05B 45/30* (2020.01); *F21K 9/64* (2016.08); *F21S 10/00* (2013.01); *F21V 7/048* (2013.01); *F21V 7/06* (2013.01); *F21V 23/003* (2013.01); *F21V 23/04* (2013.01); *F21Y 2115/10* (2016.08)

(58) Field of Classification Search

CPC ..... F21K 9/62

See application file for complete search history.

(56) References Cited

U.S. PATENT DOCUMENTS

2008/0062682 A1* 3/2008 Hoelen ..... F21V 7/0091 362/231

2008/0310158 A1* 12/2008 Harbers ..... H01L 25/0753 362/240

(Continued)

*Primary Examiner* — Andrew J Coughlin

(74) *Attorney, Agent, or Firm* — Neugeboren O'Dowd Tutunjian & Bitetto

(57) ABSTRACT

A light device and method for producing an output light beam are disclosed. A light source assembly comprising a plurality of light sources is arranged at the first end of the light device and emits light towards the second end and parallel with the longitudinal axis of the device. The device also has a chamber for mixing light emitted from the light source assembly; and a concave reflecting optic for redirecting light exiting the chamber and emitted onto the optic. The redirected light forms an output light beam. The device also has driver circuitry for controlling drive currents to the plurality of light sources individually or in groups thereof to thereby variably control a divergence of the output light beam.

19 Claims, 6 Drawing Sheets

(51) Int. Cl.
*F21V 7/04* (2006.01)
*F21V 23/04* (2006.01)

(56) References Cited

U.S. PATENT DOCUMENTS

2010/0134016 A1* 6/2010 York ..... F21K 9/62
315/113
2012/0327655 A1* 12/2012 Li ..... G02B 19/0066
362/235
2013/0058104 A1* 3/2013 Catalano ..... F21V 7/06
362/335
2013/0200407 A1* 8/2013 Roth ..... F21V 7/0016
257/91
2014/0198480 A1* 7/2014 Dai ..... G02B 5/0205
362/84
2014/0254153 A1* 9/2014 Vissenberg ..... F21V 7/0016
362/235
2016/0102844 A1* 4/2016 Ebner ..... F21V 7/041
362/241

* cited by examiner

VARIABLE BEAM SOURCE WITH MIXING CHAMBER

CLAIM OF PRIORITY UNDER 35 U.S.C. § 119

The present application for patent claims priority to patent application Ser. No. 14/966,537 entitled "VARIABLE-BEAM LIGHT SOURCE WITH MIXING CHAMBER" filed Dec. 11, 2015, which claims Priority to Provisional Application No. 62/090,567 entitled "VARIABLE-BEAM LIGHT SOURCE WITH MIXING CHAMBER" filed Dec. 11, 2014, and assigned to the Assignee hereof, the entire contents of which are hereby expressly incorporated by reference herein.

TECHNICAL FIELD

The present invention relates to illumination devices including adjustable light sources.

BACKGROUND

Light-emitting diodes (LEDs), particularly white LEDs, have increased in size in order to provide the total light output needed for general illumination. As LED technology has advanced, the efficacy (measured in lumens/Watt) has gradually increased, such that smaller die areas now produce as much light as was previously created by emission from far larger die areas. Nonetheless, the trend favoring higher light outputs has led to larger semiconductor LED die sizes, or, for convenience, arrays of smaller die areas in series or series-parallel arrangements. Series arrangements are generally favored because the forward voltage of LEDs varies slightly, resulting, for parallel arrangements, in an uneven distribution of forward currents and, consequently, uneven light output.

For many applications, it is desirable to have a light source that produces a light beam having a variable angular distribution. Variability is needed, for example, to create a wide-angle light beam for illuminating an array of objects, or a narrow-angle beam for illuminating a single, small object. Conventionally, the angular distribution is varied by moving the light source(s) (e.g., the LED arrangement) toward or away from the focal point of a lens or parabolic mirror. As the light source is moved away from the focal point, its image is blurred, forming a wider beam. Unfortunately, in doing so, the image is degraded, becoming very non-uniform. A need, therefore, exists for light sources that produce variable beam angles with uniform illumination and without sacrificing beam quality.

SUMMARY

In one example, a light device for producing an output light beam is provided. The light device has a first end, a second end, and a longitudinal axis extending therebetween. A light source assembly comprising a plurality of light sources is arranged at the first end of the light device and is configured to emit light towards the second end and parallel with the longitudinal axis. The device also has a chamber for mixing light emitted from the light source assembly. The device also has a concave reflecting optic for redirecting light exiting the chamber and emitted onto the optic, the redirected light forming an output light beam. The chamber is positioned between the light source assembly and the concave reflecting optic. The device also has driver circuitry for controlling drive currents to respective ones of the plurality of light sources individually or in groups thereof to thereby variably control a divergence of the output light beam, the output light beam exiting the second end of the light device.

In another example, a method of producing an output light beam is provided. The method includes providing a light device having (i) a plurality of light sources arranged and configured to emit light in a direction parallel with a longitudinal axis, (ii) a chamber, and (iii) a concave reflecting optic for redirecting light exiting from the chamber and emitted onto the optic. The method also includes driving the light sources to create a plurality of secondary light beams; mixing the plurality of secondary light beams in the chamber; and controlling drive currents to the light-emitting devices, individually or in groups thereof, based on distances of the devices from a center region of the devices so that the output light beam has a divergence variably determined, at least in part, by the controlled drive currents.

DETAILED DESCRIPTION

Some embodiments of the present invention provide light sources that include an arrangement of individually controllable LEDs (or individually controllable groups of LEDs) coupled with a light mixing chamber; the LEDs and mixing chamber may be fixedly located relative to a concave reflecting optic. In some examples, the LEDs are placed at the bottom of the mixing chamber (i.e., where light enters the chamber), and the top of the mixing chamber (i.e., where light exits from the chamber) is placed at or near the focus of the reflecting optic. The mixing chamber effectively "mixes" light emitted from the LEDs to remove optical artifacts created due to "dark" (non-light-emitting) space between the LEDs, and thereby produce uniform illumination output.

Variable beams can be achieved by selectively driving the individual (groups of) LEDs, e.g., depending on their distance from the center of the LED arrangement. For example, when only LEDs at or near the center are turned on, a light beam emitted from the LEDs is first mixed in the mixing chamber and subsequently redirected by the reflecting optic to create a uniform narrow beam. In contrast, when LEDs throughout the arrangement are turned on, the emitted light, after being mixed in the mixing chamber, is redirected by the optic to create a uniform wider-angle beam. Thus, some embodiments of the current invention provide adjustable beam divergence with uniform illumination without physically moving the LEDs relative to the optic.

As used herein, the term "substantially" or "approximately" means±10%, and in some embodiments, ±5%. As used herein, all fixed relative terms or descriptions, such as "flat" or "an angle" mean within reasonable manufacturing tolerances.

Figure 1A:
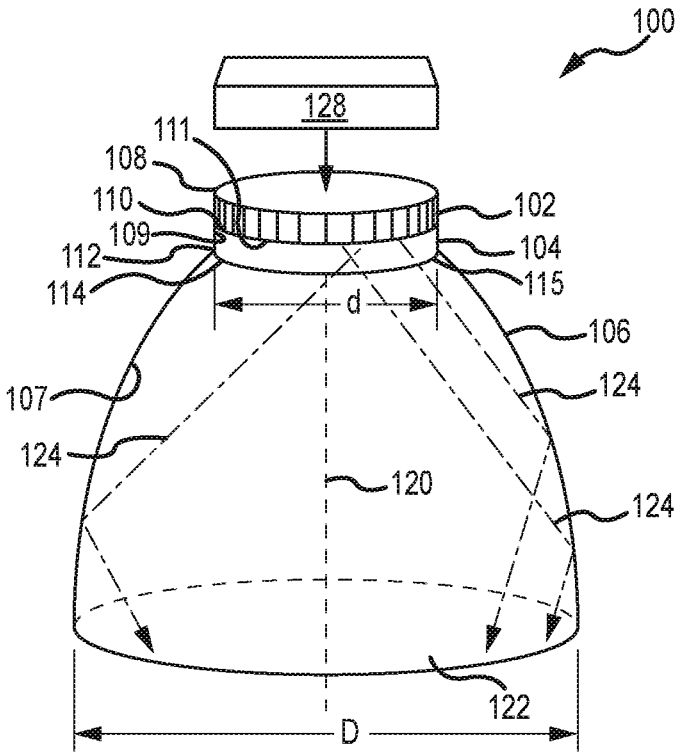
FIG. 1A is a perspective partially transparent view of a light device according to some embodiments.

Referring to FIG. 1A, in various embodiments, the light device 100 includes a light source 102, a mixing chamber 104, and a concave reflecting optic 106 having a reflective surface 107 that faces the light source 102 and the mixing chamber 104. The light source 102 may include a linear array of small light-emitting diodes (LEDs) disposed (e.g., one or more than one die) on a substrate 108 for providing a high light output (e.g., 40 lm/cm). The LEDs may be spaced relatively close together (e.g., 1 cm apart). Alternatively, the light source 102 may include a single large LED die or multiple parallel linear LED arrays disposed on a substrate 108. Because the LEDs may be separated by dark regions that do not illuminate, undesired artifacts and spatial non-uniformity may be created in the output illumination. Light emitted by the LEDs or light source 102 may be referenced herein as secondary light beams, while light exiting the device 100 may be referenced herein as an output light beam.

These artifacts may be reduced by faceting and/or texturing at least a portion of the interior reflective surface 107 of the reflector 106. Alternatively or additionally, the mixing chamber 104 may be utilized to reduce optical artifacts.

In various embodiments, the LED array 102 and the substrate 108 form a first region, which may be referred to as an entry region or a bottom surface 110 of the mixing chamber 104 (i.e., where light enters the chamber). The LED array 102, which is typically (but not necessarily) positioned symmetrically within the mixing chamber 104, may extend all the way to a side surface 112 of the chamber 104, or be of smaller dimensions.

The dark regions between the LEDs on the substrate 108 may include a highly reflective surface 111 (e.g., reflecting at least 90% of the light emitted thereupon). In one embodiment, the mixing chamber 104 has a cylindrical interior surface 109 that is highly reflective. For example, a diffuse or a specular reflecting surface may be suitable to be employed on or as the interior surface 109 of the mixing chamber 104. Additionally, the mixing chamber 104 may include an exit region, which may be referred to as a top surface or a top region 114, through which light exits from the chamber 104 to the reflecting optic 106; the top region 114 may have a diffusing material 115 that is made of one or more materials that can effectively diffuse the light (e.g., a ground glass diffuser) positioned between the bottom surface 110 and the reflecting optic 106. As a result, the mixing chamber 104 may effectively "mix" light emitted from the LED array 102 to produce uniform illumination output to the reflecting optic 106 and thereby effectively remove (or at least reduce) the optical artifacts created due to dark space between the LEDs.

Figure 1B:
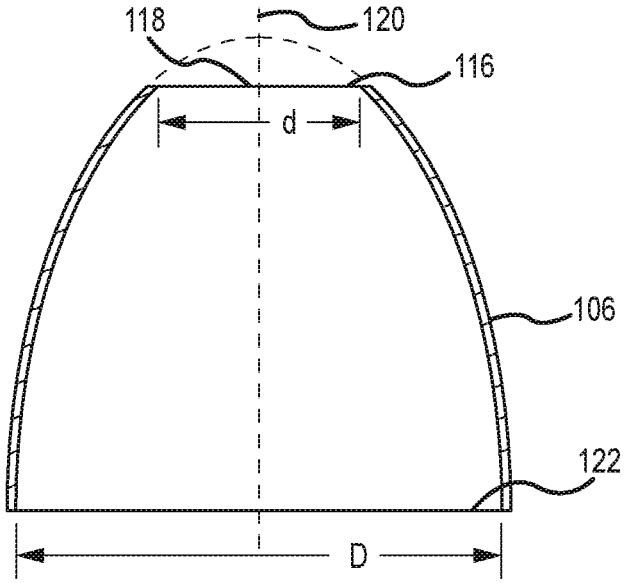
FIG. 1B is a side section view of the device in FIG. 1A.

Referring to FIG. 1B, in various embodiments, the reflecting optic 106 is a concave or parabolic reflector (i.e., a reflecting optic whose reflective surface forms a truncated paraboloid). The parabolic reflector 106 is truncated at the focal plane 116 (i.e., a plane through the focal point 118 and is perpendicular to the optical axis 120, or symmetry axis, of the paraboloid).

Figure 1C:
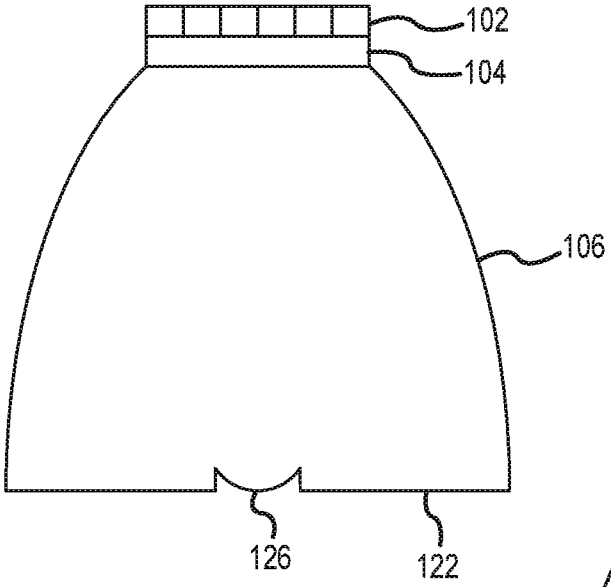
FIG. 1C is a side view of a light device according to some embodiments.
Figure 1D:
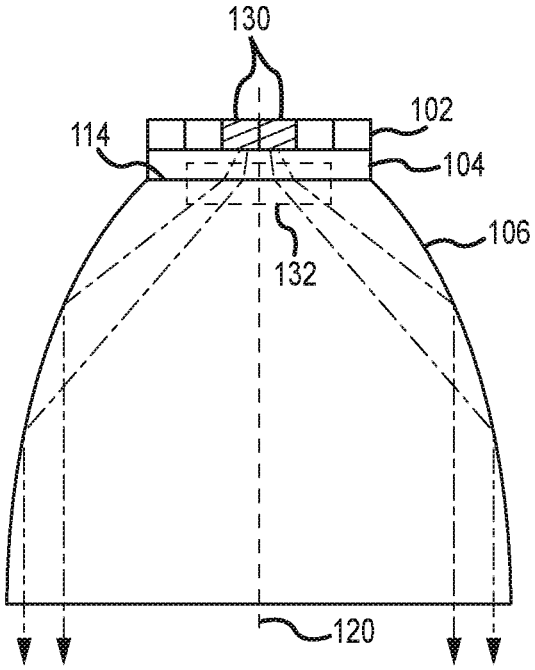
FIG. 1D is a side section view of a light device according to some embodiments.
Figure 1E:
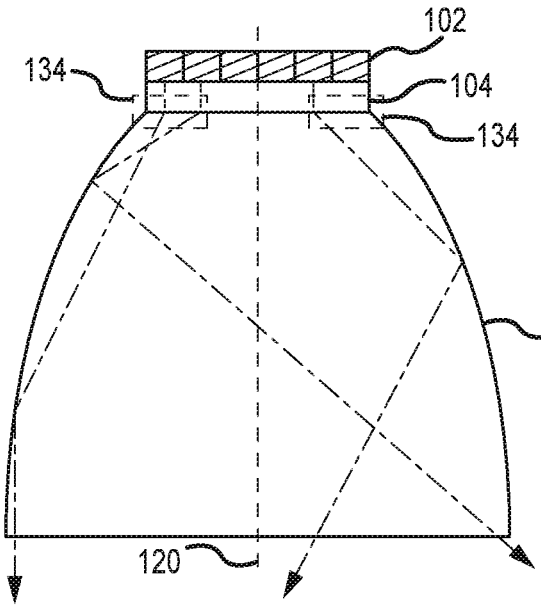
FIG. 1E is a side section view of a light device according to some embodiments.
Figure 1F:
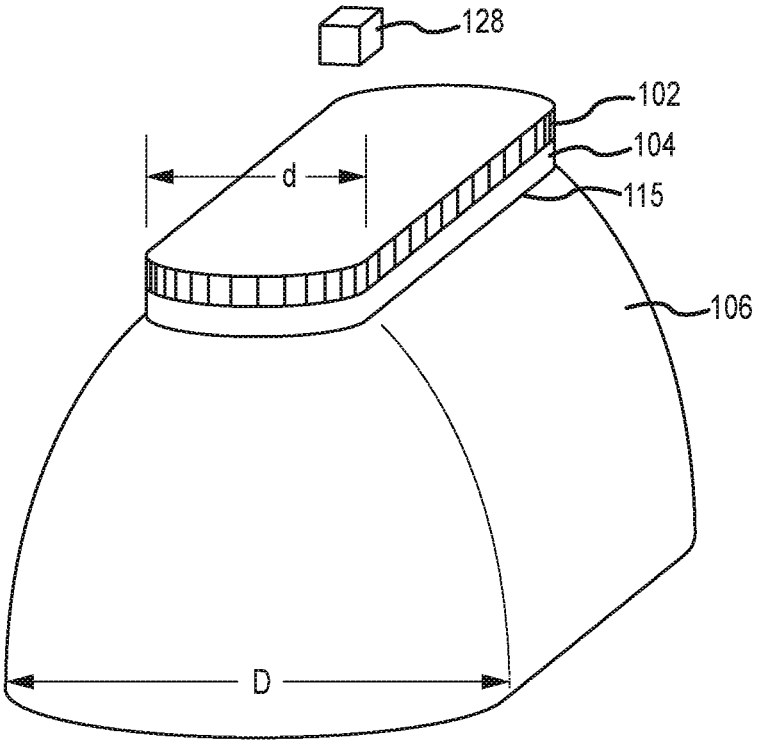
FIG. 1F is a perspective view of a light device according to some embodiments.

In some examples, the top surface 114 of the mixing chamber 104 is placed substantially at the focal plane 116 of the parabolic reflector 106 and has an inner dimension or a diameter d that is substantially equal to the inner dimension or diameter of the focal plane 116 (compare e.g. FIGS. 1A, 1B, and 1F). The top surface 114 thus constitutes the exit surface of the mixing chamber 104 and an entry surface of the reflector 106. Light exiting from the top surface 114 (or the focal plane 116) is directed by the reflector 106 toward the aperture 122 of the reflector 106.

In some embodiments, the inner dimension or diameter D of the aperture 122 of the reflector 106 is greater than the inner dimension or diameter d of the mixing chamber 104 (e.g., by a factor of at least two, three, or more). Larger D/d ratios may result in more emitted light being captured by the reflector 106, further resulting in a brighter the reflected beam.

Referring again to FIG. 1A, light rays 124 exiting from the mixing chamber 104 and incident upon the parabolic reflective surface or interior reflective surface 107 are generally reflected at an angle directing them toward the optical axis 120. Thus, light emitted by the array 102 into a large solid angle (e.g., according to a Lambertian distribution, in which the luminous intensity is proportional to the cosine between the observer's line of sight and the optical axis 120) is at least partially collimated so as to form a directed output beam. Light that leaves the aperture 122 directly without striking the reflective surface, however, generally retains its large divergence and may, therefore, not (or not significantly) contribute to the output beam.

To capture the centrally emitted light described in the preceding paragraph, some embodiments include a central lens along the optical axis 120. For example, a TIR (total internal reflection) optic as depicted in FIG. 1C may include a collimating lens surface 126 recessed (as shown) or protruding from the exit surface 122. Such a lens surface 126 may result in an increased central beam intensity of the output beam.

In various embodiments, the light source 102 has a plurality of LEDs that are individually addressable, or addressable in multiple groups (each having a plurality of devices), with suitable driver circuitry 128 (shown in FIGS. 1A, 1F), to facilitate the selective activation and de-activation of various ones of the plurality of LEDs, and the control over the brightness levels of individual LEDs or groups of LEDs via the respective drive currents. Groups of LEDs may be formed by electrically connecting multiple individual LED die such that the LEDs within the group are all driven by the same current (in a series arrangement) or by approximately equal currents (in a parallel arrangement). The output beam of such a light source can be varied in divergence angle (which may be defined, e.g., based on the distance from the beam center at which the intensity or the luminous intensity has fallen to 50% of the (luminous) intensity at the center) by driving the individual (groups of) LEDs depending on their distance from the center of the arrangement.

The underlying operational principle of the preceding paragraph is illustrated in FIGS. 1D and 1E. As shown, light emitted from the center region 130 of the LED array 102 first strikes the central portion 132 of the top surface 114 of the mixing chamber 104 and is subsequently redirected by the reflector 106 in a direction parallel to the optical axis 120. Light emitted from exterior, distal (that is, those LEDs that are further away from the optical axis 120), or off-axis LEDs 102, on the other hand, may strike the edge portion 134 of the top surface 114 and be reflected at an angle relative to the optical axis 120, resulting in divergence of the output beam. The greater the distance of the emission point within the LED array 102 from the center 130 is, generally the larger will be the angle between the reflected ray and the optical axis 120. Consequently, as more LEDs 102 are turned on, starting from the center 130 of the array—in other words, as the effective size of the array 102 increases—the output-beam divergence likewise increases.

Figure 2A:
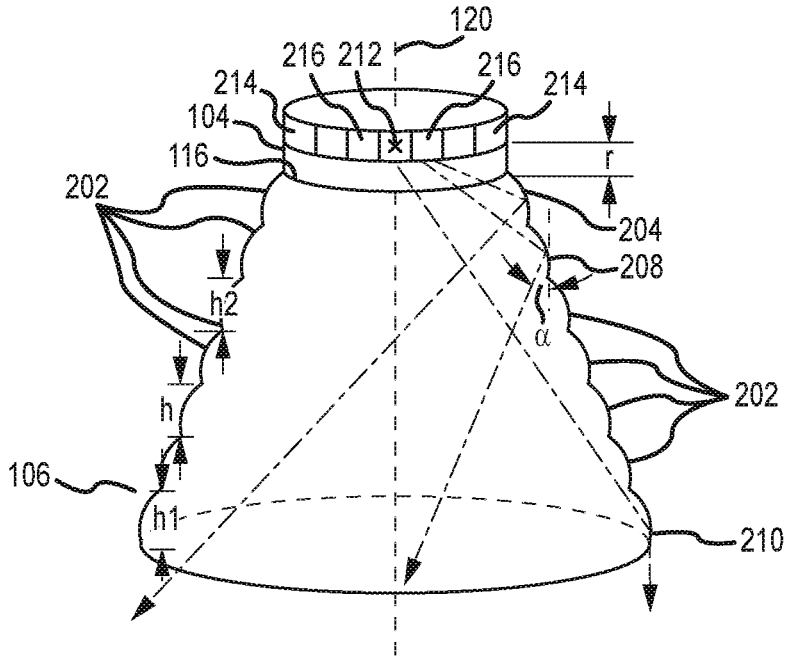
FIG. 2A is a perspective partially transparent view of a light device according to some embodiments.

An alternative or further enhancement of the range of beam angles may be achieved by modifying the reflector 106. Referring to FIG. 2A, in one embodiment, the reflector 106 may be constructed from a series of parabolic segments 202; the segments 202 may overlap and nest, one inside the other. At least one segment 202 or each segment 202 may have a different parabola height h (e.g., a conic section) to direct light emitted thereon at a different aiming angle α with respect to the axis of symmetry 120, thereby creating a controlled beam divergence. Compare segment 202 having a first height h to a segment 202 having a second height h2. In some examples, the reflector segment 204 closest to the focal plane 116 (or top surface 114 of the mixing chamber 104) has the most divergent parabola (i.e., it reflects light emitted from the LED array 102 at the largest angle relative to the optical axis 120 of the paraboloid). The successive segments 208 of the parabolic reflector 106 have lower divergences, and finally the segment 210 that is farthest away from the focal plane 116 redirects the light to form a collimated beam (i.e., at an orientation angle of)−90°.

Continuing with FIG. 2A, the segments closest to the focal plane 116 receive much less light from the LEDs than the segments near the top of the reflector 106, because the light intensity coming from the LEDs follows a Lambertian (i.e., Cosine) distribution. Therefore, if zero degrees is along the optical axis, then at zero degrees the intensity would be nil. In order to control the "shape" (i.e., intensity vs angle of the light source) of the light beam, one may adjust the height h, h1, h2 of each segment 202. To direct more light out to the sides, the height h, h1, h2 would be larger at the bottom or distal end of the device 100, where the output beam exits—that is, the first height h1 would be greater than the second height h2.

Figure 2B:
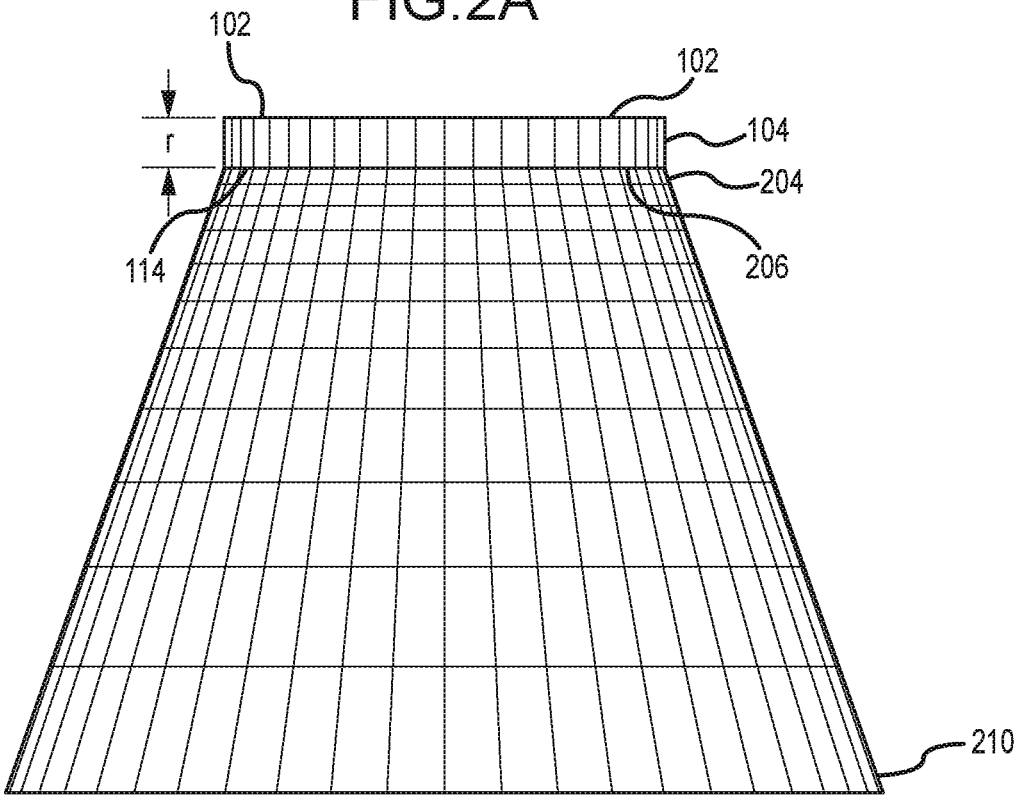
FIG. 2B is a side view of a reflector with a graded angle of dispersion for the exiting light.

FIG. 2B illustrates a parabolic reflector 106 having a graded aiming angle α to direct the light exiting from the top surface 114 of the mixing chamber 104 at a range of angles as described above. The aiming angles of the segments 202 in this design may decrease linearly from −90° (directed by the segment 210, farthest from the focal plane 116) to an angle (e.g., −35°) approximately equal to the desired widest beam angle (directed by the segment 204, closest to the focal plane 116).

Referring again to FIG. 2A, the amount of light exiting the mixing chamber 104 onto the segments 202 depends on the overall distance between the activated LED(s) and the center 212 of the LED array. For example, a greater distance between an off-axis LED 214 and the center 212 of the LED array 102 results in a greater amount of light striking the reflector 106 from the off-axis LED (due to the Lambertian distribution), whereas relatively little light emitted from an LED 216 near the array center 212 encounters the reflector. As a result, the segment 204 closest to the focal plane 116 (or top surface of the mixing chamber 104) may direct a larger amount of light emitted from LEDs 214 more distant from the array center 212 in order to create a more divergent beam, thereby increasing the divergence angle of the wide beam. As LEDs are turned on from the center 212 (which generates the narrow beam) to the edge of the array (which generates the wide beam), the current invention may significantly enhance the range of the beam angles by allowing the reflector 106 to separately "address" each region of the LED array.

To maximize the center beam brightness and optimize the angle of the emitted beams, several approaches may be utilized. First, because the focal point 118 of the reflector 106 lies at the center of the focal plane 116, the top surface 114 may include various diffusing properties across its surface area (e.g., from the center to the edge) to adjust the amount of light diffusion. For example, the center of the surface may be less diffusive to maximize the center beam brightness, while the edge of the surface may be more diffusive to maximize the angle of the beam. In addition, for a given design angle θ (i.e., the angle subtended by the reflector 106 as measured from the focal plane 116 to the edge of the reflector through which light exits), the larger the diameter d of the focal plane 116, the smaller will be the achievable angle of a narrow beam. In various embodiments, the diameter d of the focal plane 116 (and thus the diameter of the mixing chamber 104) is larger than the largest dimension of the LED array 102 (e.g., the diagonal of a rectangular arrangement) by at least a factor of two.

Figure 3:
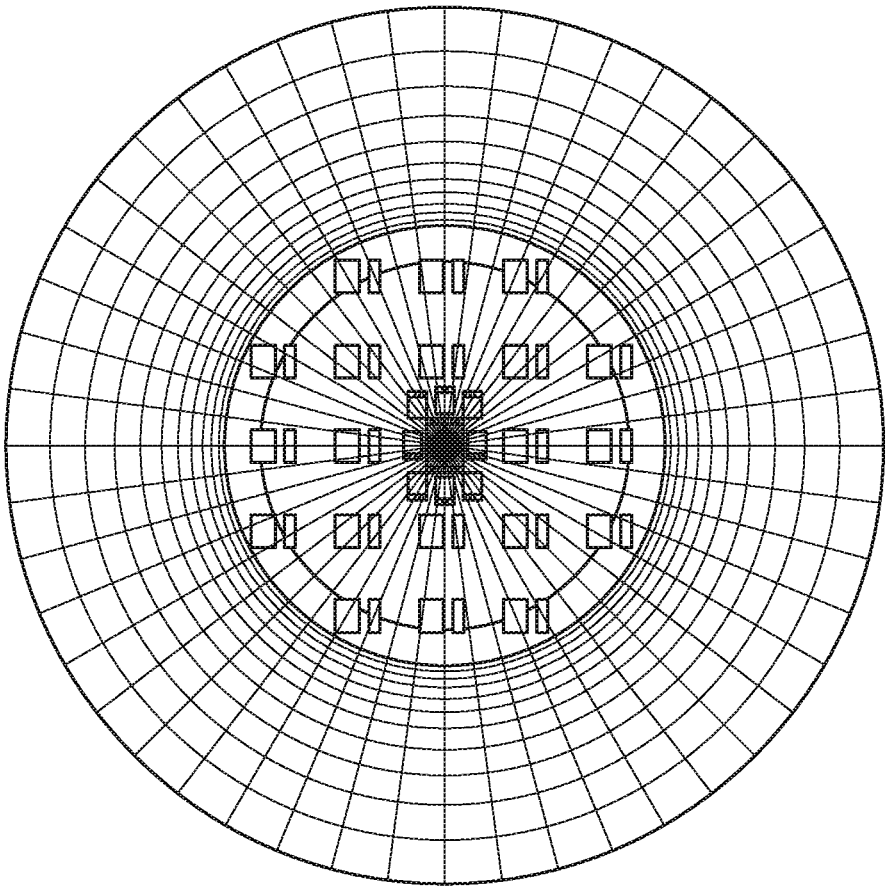
FIG. 3 illustrates an LED array according to some embodiments.

Further, the central beam intensity may be enhanced by increasing the surface intensity of the LEDs near the focal point 118 (or the center of the top surface 114 of the mixing chamber 104). In one embodiment, small and high-power LEDs are utilized near the center region of the LED array 102, whereas large and low-power LEDs are used around the periphery of the LED array 102 (since they mainly contribute to brightness at wide angles). As understood herein, the 'center region" may include all LEDs except the sequence of LEDs forming the periphery of the pattern. Alternatively, the "center region" may include only a fraction of the radial extent of the pattern—e.g., 10%, 20%, 50%, etc. FIG. 3 illustrates the LED arrangement where densely packed LEDs are located at the center region and larger, spaced-apart LEDs are placed at the regions away from center. In some embodiments, the LEDs are arranged in a regular array forming a number of rows and columns. For example, as shown in FIG. 3, the array may lie on rectangular coordinate nodes and approximate the typically circular opening of the mixing chamber 104 by containing fewer LEDs in the upper and lower rows. Because the reflector 106 has circular symmetry and may reproduce such symmetry in the directed light beam, arranging LEDs on rectangular coordinates may avoid the formation of circular bright bands, thereby eliminating undesirable artifacts. Thus, this arrangement may also reduce the required amount of diffusion from the mixing chamber 104.

Although the mixing chamber 104 may effectively reduce optical artifacts and spatial non-uniformity of the illumination output resulting from the dark regions between the LEDs, its length r along the optical axis 120 (i.e., the distance between the first or bottom region 110 and a second region or top surface 114) may affect the angle of the narrow beam. As the mixing chamber 104 has a smaller length r, the LEDs 102 are closer to the focal plane 116 (which effectively acts as a rear-projection "screen"); this results in better imaging of the LEDs on the screen, thereby creating artifacts. Increasing the mixing chamber length r (i.e., moving the LEDs 102 away from the screen) causes light emitted from each LED to overlap on the screen, thereby producing more uniform illumination; this, however, widens the narrow beam. Accordingly, there exists a tradeoff between the appearance of artifacts and the minimum narrow-beam angle that the device can achieve. In some embodiments, the mixing chamber 104 has a length r ranging from 2 mm to 10 mm, preferably between 3 mm and 5 mm. In addition, a narrow beam with a beam angle at or near the lower limit may be achieved using, again, smaller LED dies near the center of the LED array 102.

In various embodiments, the mixing chamber 104 provides both functions of light diffusion and creation of white light. For example, the top surface 114 may include a transparent plate coated with an appropriate phosphor mixture. Because the phosphor mixture may scatter light over a wide range of scattering angles, it thereby effectively acts as a diffuser. The beam angle of the narrow beam can, again, be controlled by the proximity of the LEDs 102 to the phosphor surface (i.e., the length r of the mixing chamber 104 illustrated in FIG. 2B). In addition, the phosphor may absorb at least some of the light emitted from the LEDs 102 and re-emit at least some of the absorbed light in a spectrum containing one or more wavelengths that are longer than the LED emitting light (which is typically blue). For example, a $(Gd, Y)_3(Al, Ga)_5O_{12}$ phosphor may be used to convert blue LED light to yellow light. Both converted and unconverted light may be mixed to create white light. Additionally, various light colors may be generated by using small groups of LEDs, each including a different LED color. For example, red, green, and blue LEDs may be combined in individual groups, replacing individual LEDs (as discussed above), to mix the light locally. Selectively activating the group(s) of LEDs can create various colored light. Alternately, several LEDs, each with a different correlated color temperature or CCT (temperature of a Planckian radiator), may be placed in groups in an array that allows for the adjustment of color temperature and beam angle simultaneously.

Although this disclosure has focused on describing a single mixing chamber 104 in the device 100, those skilled in the art will understand that a plurality of mixing chambers 104 is contemplated. In some embodiments, a plurality of mixing chambers are disposed separately, such as by next to each other, or end-to-end (that is, a first mixing chamber 104 may be between the first end of the device and a second mixing chamber 104 along the longitudinal axis X of the device 100). In some embodiments, a plurality of mixing chambers 104 are disposed concentrically about the longitudinal axis X. In some embodiments, a first mixing chamber is disposed about the longitudinal axis X, and a second mixing chamber is disposed about the first mixing chamber. In some embodiments, a first mixing chamber effects a first degree of light scatter, and a second mixing chamber effects a second degree of light scatter, the second degree different from the first degree. For example, the first mixing chamber may effectuate a more random scattering of light than the second mixing chamber, or vice versa, with the device 100 emitting a different quality of output beam. A reflective wall may divide at least a portion of the mixing chambers.

Those skilled in the art will also understand that the second or top region 114 of the mixing chamber 104 may have a surface or wall at or near the focal plane 116 that is not uniform. For example, a first portion of the top region 114 or wall may effect a first degree of diffusion of light passing therethrough, and a second portion of the top region 114 or wall may effect a second degree of diffusion of light passing therethrough, the second degree of diffusion different from the first degree of diffusion. In some embodiments, the first degree of diffusion is less than the second degree of diffusion.

Figure 4:
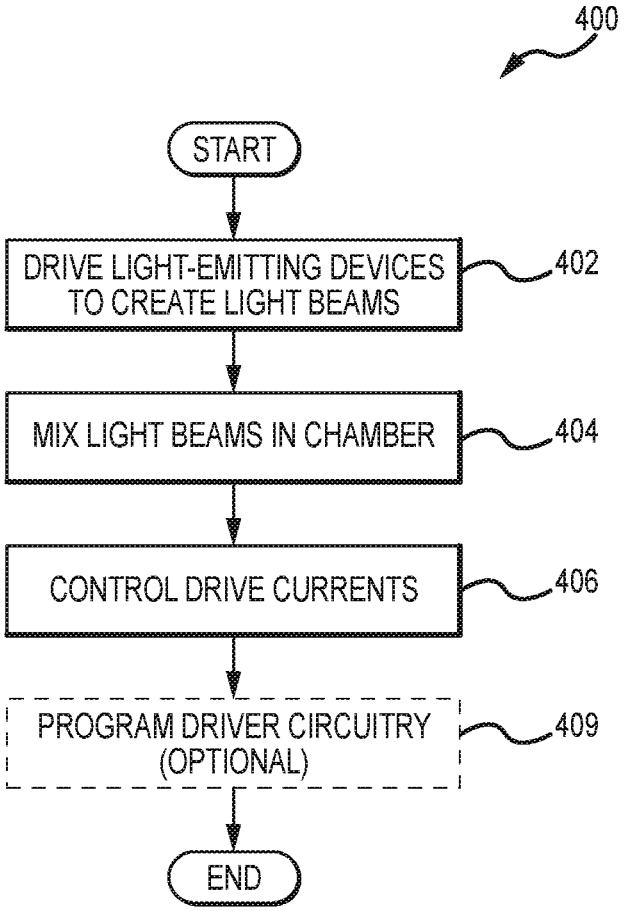
FIG. 4 is a flowchart of a method according to some embodiments.

Turning now to FIG. 4, a method 400 of varying a divergence of a light source with uniform illumination is now described. The light source of the method 400 has (i) a plurality of light-emitting devices arranged on a plane or a substrate, and/or configured to emit light parallel to a longitudinal axis, (ii) a chamber, and (iii) a concave reflecting optic for redirecting light exiting from the chamber and emitted onto the optic. The method 400 includes driving (402) the light-emitting devices to create light beams, and mixing (404) the light beams in the chamber. The method 400 also includes controlling 406 drive currents to the light-emitting devices, individually or in groups thereof, based on distances of the devices from a center region of the devices so that the beams have a divergence variably determined, at least in part, by the controlled drive currents.

The method 400 may optionally include programming 408 driver circuitry controlling the drive currents.

The terms and expressions employed herein are used as terms and expressions of description and not of limitation, and there is no intention, in the use of such terms and expressions, of excluding any equivalents of the features shown and described or portions thereof. In addition, having described certain embodiments of the invention, it will be apparent to those of ordinary skill in the art that other embodiments incorporating the concepts disclosed herein may be used without departing from the spirit and scope of the invention. For example, while the invention has been described with respect to embodiments utilizing LEDs, light sources incorporating other types of light-emitting devices (including, e.g., laser, incandescent, fluorescent, halogen, or high-intensity discharge lights) may similarly achieve variable beam divergence if the drive currents to these devices are individually controlled in accordance with the concepts and methods disclosed herein. Accordingly, the described embodiments are to be considered in all respects as only illustrative and not restrictive.

Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a reflector should be understood to encompass disclosure of the act of reflecting—whether explicitly discussed or not—and, conversely, were there only disclosure of the act of reflecting, such a disclosure should be understood to encompass disclosure of a "reflector mechanism". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

The invention claimed is:

1. A lighting device comprising:

a light source assembly comprising a first region of centrally positioned light sources emitting light having a minimum divergence from a direction that is parallel to a longitudinal axis of the lighting device and at least one second region of light sources in which divergence of light being emitted increases with increasing distance from the first region of the centrally positioned light sources, wherein light sources in said first region and said at least one second region may be selected for controlling divergence of output light beams being emitted from the lighting device, wherein the output light beams collectively provide uniformly projected light substantially free of artifacts;

a mixing chamber for receiving light from the light source assembly, wherein the mixing chamber removes lighting artifacts resulting from spacing between the light sources in said first region and said at least one second region; and a reflecting optic having a first curved portion of a light beam reflecting surface that reflects light beams generated by the first region of centrally positioned light sources and received from the mixing chamber to a direction substantially parallel with the direction that is parallel to the longitudinal axis of the lighting device, said reflecting optic having a second curved portion of said light beam reflecting surface that reflects light generated by the second region of centrally positioned light sources to be divergent from said direction being substantially parallel with the direction that is parallel to the longitudinal axis of the lighting device.

2. The lighting device of claim 1, wherein said increasing distance of light sources in the at least one second region is in a direction perpendicular to said direction that is parallel to the longitudinal axis.

3. The lighting device of claim 1, wherein the light source comprises light emitting diodes (LEDs).

4. The lighting device of claim 3, wherein the light emitting diodes (LEDs) in each of the first region and the at least one second region are connected in series to provide that each group is driven by a same current.

5. The lighting device of claim 3, wherein the light emitting diodes (LEDs) in each of the first region and the at least one second region are connected in parallel to provide that each group is driven by equal current.

6. The lighting device of claim 3 further comprising driver circuitry for controlling driver currents to the light emitting diodes (LEDs) individually.

7. The lighting device of claim 3 further comprising driver circuitry for controlling driver currents to the light emitting diodes (LEDs) in groups.

8. The lighting device of claim 1, wherein the light source comprises at least one linear array of light emitting diodes (LEDs).

9. The lighting device of claim 8, wherein the at least one linear array of light emitting diodes (LEDs) provides a parallel arrangement of linear arrays of light emitting diodes (LEDs).

10. The lighting device of claim 1, wherein the reflecting optic comprises a concave surface, a parabolic surface or a combination thereof.

11. The lighting device of claim 10, wherein the parabolic surface of the reflecting optic includes a truncated surface at the focal plane.

12. The lighting device of claim 11, wherein a light exit surface of the mixing chamber is present at the truncated surface of the reflecting optic having the parabolic surface.

13. The lighting device of claim 12, wherein the light exit surface of the mixing chamber comprises a light diffusing material of ground glass.

14. The lighting device of claim 12, wherein a diameter of the mixing chamber is substantially equal to a diameter of the truncated surface of the reflecting optic at the focal plane.

15. The lighting device of claim 12, wherein a diameter of the entry to the reflecting optic is greater than a diameter of the light exit surface of the mixing chamber.

16. The lighting device of claim 1, wherein the reflecting optic includes an exit surface having a collimating lens portion.

17. The lighting device of claim 1, wherein the light beams generated by the first region of centrally positioned light sources contact a central portion of the light exit surface of the mixing chamber that directs the light beams towards a portion of the sidewall of the reflecting optic that provides the first portion of the light beam reflecting surface and has a geometry to provide redirection of the light beams to be substantially parallel to the direction of the longitudinal axis for the lighting device.

18. The lighting device of claim 1, wherein light beams generated by said at least one second region of light sources contact an edge portion of the light exit surface of the mixing chamber that directs the light beams towards a portion of the sidewall of the reflecting optic that provides a second portion of the light reflecting surface and has a geometry to provide redirection of the light beams to be divergent from the direction of the longitudinal axis of the lighting device.

19. The lighting device of claim 1, wherein the light beam reflecting surface comprises sidewalls having a series of parabolic segments, wherein successive segments in said series of parabolic segments produce a lesser divergence of light beams from the direction of the longitudinal axis of the lighting device with increasing distance from the focal plane.

* * * * *